US008813867B2

(12) United States Patent
Peterson et al.

(10) Patent No.: US 8,813,867 B2
(45) Date of Patent: Aug. 26, 2014

(54) VIBRATION ISOLATION IN A HANDHELD FLUID SPRAYER

(75) Inventors: Craig L. Peterson, Carver, MN (US); Michael B. Jones, Excelsior, MN (US); Wayne D. Robens, Lakeville, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 981 days.

(21) Appl. No.: 12/907,554

(22) Filed: Oct. 19, 2010

(65) Prior Publication Data

US 2011/0240766 A1 Oct. 6, 2011

Related U.S. Application Data

(63) Continuation-in-part of application No. 12/754,212, filed on Apr. 5, 2010, now abandoned.

(51) Int. Cl.

| | |
|---|---|
| ***B25D 17/00*** | (2006.01) |
| ***B25D 17/11*** | (2006.01) |
| ***B25D 17/24*** | (2006.01) |
| ***B05B 7/02*** | (2006.01) |
| ***B05B 9/043*** | (2006.01) |
| ***B05B 9/08*** | (2006.01) |
| *B05B 7/24* | (2006.01) |

(52) U.S. Cl.

CPC ..... *B05B 9/0861* (2013.01); *B05B 7/2402* (2013.01)

USPC ..... 173/162.2; 173/162.1; 239/333; 239/526; 248/562; 417/363

(58) Field of Classification Search

USPC ..... 239/332, 333, 375, 525, 526, DIG. 14; 248/560, 562, 568, 570, 636; 417/363, 417/423.14, 423.15; 173/162.1, 162.2

See application file for complete search history.

(56) References Cited

U.S. PATENT DOCUMENTS

| | | | | | |
|---|---|---|---|---|---|
| 3,620,269 | A | * | 11/1971 | Lange et al. | 30/381 |
| 3,937,092 | A | | 2/1976 | Hawkins | |
| 4,401,167 | A | * | 8/1983 | Sekizawa et al. | 173/162.1 |
| 4,693,423 | A | | 9/1987 | Roe et al. | |
| 5,052,500 | A | * | 10/1991 | Ohtsu | 173/162.2 |
| 5,395,052 | A | | 3/1995 | Schneider et al. | |
| 5,607,023 | A | | 3/1997 | Palm | |
| 5,692,574 | A | * | 12/1997 | Terada | 173/162.2 |
| 5,697,456 | A | | 12/1997 | Radle et al. | |
| 7,056,102 | B2 | | 6/2006 | Cremer et al. | |
| 7,182,280 | B2 | * | 2/2007 | Ye et al. | 239/526 |
| 7,640,997 | B2 | * | 1/2010 | Bram et al. | 173/162.2 |
| 2007/0278787 | A1 | | 12/2007 | Jones et al. | |

* cited by examiner

*Primary Examiner* — Ryan Reis

(74) *Attorney, Agent, or Firm* — Christopher J. Volkmann; Kelly, Holt & Christenson, PLLC

(57) ABSTRACT

In one example, a handheld fluid sprayer is provided and includes a housing, an assembly having at least one of a motor and a fluid pump, and at least one assembly support feature. The assembly is mounted to the housing with the at least one assembly support feature. The at least one assembly support feature includes a first portion having first and second opposed surfaces and a second portion having first and second opposed surfaces. The second portion extends from the first portion such that at least one of the first and second surfaces of the second portion is at least substantially orthogonal to the second surface of the first portion.

17 Claims, 12 Drawing Sheets

VIBRATION ISOLATION IN A HANDHELD FLUID SPRAYER

CROSS-REFERENCE TO RELATED APPLICATION

The present application is a continuation-in-part of and claims priority of U.S. patent application Ser. No. 12/754,212, filed on Apr. 5, 2010, the content of which is hereby incorporated by reference in its entirety.

BACKGROUND

A fluid sprayer is one example of a device that includes a source of, or is otherwise subject to, vibration during operation. For instance, an exemplary fluid sprayer (such as a spray-coating device configured to spray paints) typically includes one or more mechanisms for generating a source of pressurized fluid material and/or atomizing air. In a handheld airless fluid sprayer, for example, an electric motor or drive typically drives a fluid pump mechanism that pumps fluid material sprayed from an output nozzle or tip. Operation of the sprayer generates significant vibration, which can result in high levels of noise emanating from the sprayer. Further, the vibration of the sprayer can lead to increased user arm fatigue and/or numbness, for example, and can affect the length of time which the user desires or is able to operate the fluid sprayer.

The discussion above is merely provided for general background information and is not intended to be used as an aid in determining the scope of the claimed subject matter.

SUMMARY

The present disclosure generally relates to vibration isolation in systems and devices that include sources of, or are otherwise subject to, vibration during operation and more specifically, but not by limitation, to vibration isolation mounts for a motor/pump assembly in a handheld fluid sprayer.

In one exemplary embodiment, a handheld fluid sprayer is provided and includes a housing, an assembly having at least one of a motor and a fluid pump, and at least one assembly support feature. The assembly is mounted to the housing with the at least one assembly support feature. The at least one assembly support feature includes a first portion having first and second opposed surfaces and a second portion having first and second opposed surfaces. The second portion extends from the first portion such that at least one of the first and second surfaces of the second portion is at least substantially orthogonal to the second surface of the first portion.

In one exemplary embodiment, a motor/pump assembly for a handheld fluid sprayer is provided. The assembly includes an assembly body housing a reciprocating member configured to reciprocate along a reciprocation axis and at least one assembly support feature extending from the assembly body and configured to support the assembly body within a fluid sprayer housing. The at least one assembly support feature includes a first portion having first and second surfaces. At least one of the first and second surfaces of the first portion defines a plane that is at least substantially perpendicular to the reciprocation axis. The at least one assembly support feature also includes a second portion having first and second surfaces. At least one of the first and second surfaces of the second portion defines a plane that is at least substantially parallel to the reciprocation axis.

In one exemplary embodiment, a vibration isolation mount for mounting a motor/pump assembly in a handheld fluid sprayer housing is provided. The vibration isolation mount includes a first component extending from one of a body of the motor/pump assembly and an interior surface of the fluid sprayer housing. The first component includes a first portion having first and second opposed surfaces and a second portion extending from the second surface of the first portion and having first and second opposed surfaces. The vibration isolation mount also includes a second component comprising a projection extending from the other one of the body of the motor/pump assembly and the interior surface of the fluid sprayer housing. The projection has an opening formed therein. The vibration isolation mount also includes a vibration isolation component configured to be received within the opening of the projection and disposed between the first component and the second component. The vibration isolation component includes a opening formed therein for accommodating the second component.

These and various other features and advantages will be apparent from a reading of the following Detailed Description. This Summary and Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

In an exemplary handheld fluid sprayer, a motor/pump assembly is mounted within a housing having a handle by which the user can carry the sprayer around a worksite. There are a number of considerations in the design of the mounting components by which the motor/pump assembly is supported in the housing. For instance, some considerations include strength and durability of the mounting components as well as resonance related to operation of the motor/pump assembly. The components utilized to mount the motor/pump assembly with the housing need to have sufficient strength characteristics (i.e., to support the weight and maintain proper alignment of the assembly within the housing, etc.) and durability (i.e., resistance to damage/breakage if dropped, etc.). While conventional mounting components may reduce vibration to some limited degree, to provide proper alignment conventional mounting components provide a significantly rigid connection to the housing. As such, during operation a significant amount of the vibration generated by the motor/pump assembly is transferred to the housing. This transferred vibration can result in significant levels of noise emanating from the housing and/or significant levels of vibration felt by the user through the handle.

Embodiments described herein provide isolation mounts for mounting a motor and/or pump assembly (referred to herein as a "motor/pump assembly") within a housing of a handheld fluid sprayer. The isolation mounts provide enhanced isolation and/or damping of vibrations generated by the motor/pump assembly and reduce the amount of noise and vibration felt by a user operating the fluid sprayer.

Figure 1:
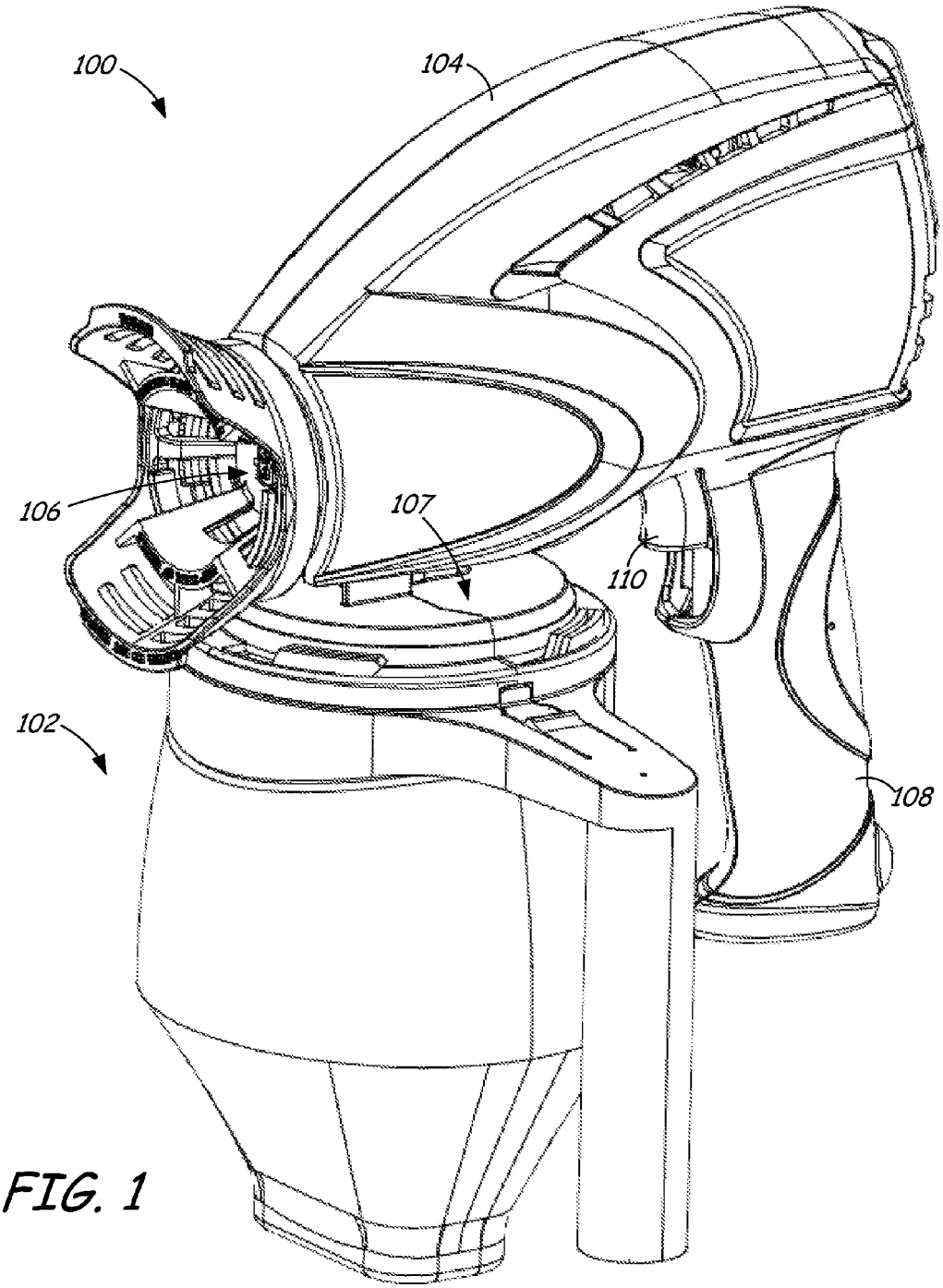
FIG. 1 is a perspective view of a handheld fluid sprayer, under one embodiment.

FIG. 1 illustrates a fluid sprayer 100 configured to spray a fluid material, supplied from a fluid container, through the air onto a surface. As used herein, "fluid material" refers to a liquid material such as, but not limited to, paints, varnishes, stains, food products, pesticides, inks, and the like. In the embodiment illustrated in FIG. 1, sprayer 100 comprises a handheld paint spray gun configured to spray atomized paint materials; however, sprayer 100 can include other configurations and can be utilized to spray other types of fluid material.

Spray gun 100 illustratively comprises an airless system and uses a fluid pump mechanism for pumping the paint material from a paint source, illustratively a fluid container 102. In other embodiments, spray gun 100 can comprise an air-driven or air-assisted system.

Spray gun 100 includes a body comprising a housing 104 containing electrical components for controlling operation of spray gun 100 and an electric drive or motor operably configured to drive the pump mechanism. The pump mechanism pumps paint supplied from a fluid container, which is delivered to an output nozzle 106 having a particular size and shape for generating a desired spray pattern. The fluid container can comprise a remote container that is physically separated from spray gun 100. In the illustrated embodiment, the fluid container comprises a container 102 that is removably coupled to a portion 107 of spray gun 100. Portion 107 comprises a fluid container cover that is supported by housing 104 and/or motor/pump assembly disposed within housing 104.

Spray gun 100 also includes handle 108 and trigger 110 that enable a user to hold and control the operation of spray gun 100. A power source (not shown in FIG. 1) supplies power for spray gun 100. For example, the power source can comprise a power cord connected to an AC power source, such as a wall outlet. In another example, the power source can comprise a battery pack. An exemplary battery pack can include primary (e.g., non-rechargeable) batteries and/or secondary (e.g., rechargeable) batteries. The battery pack can be mounted to spray gun 100 (for example, to handle 108) or can be external and connected to spray gun 100 through a power cord.

Figure 2:
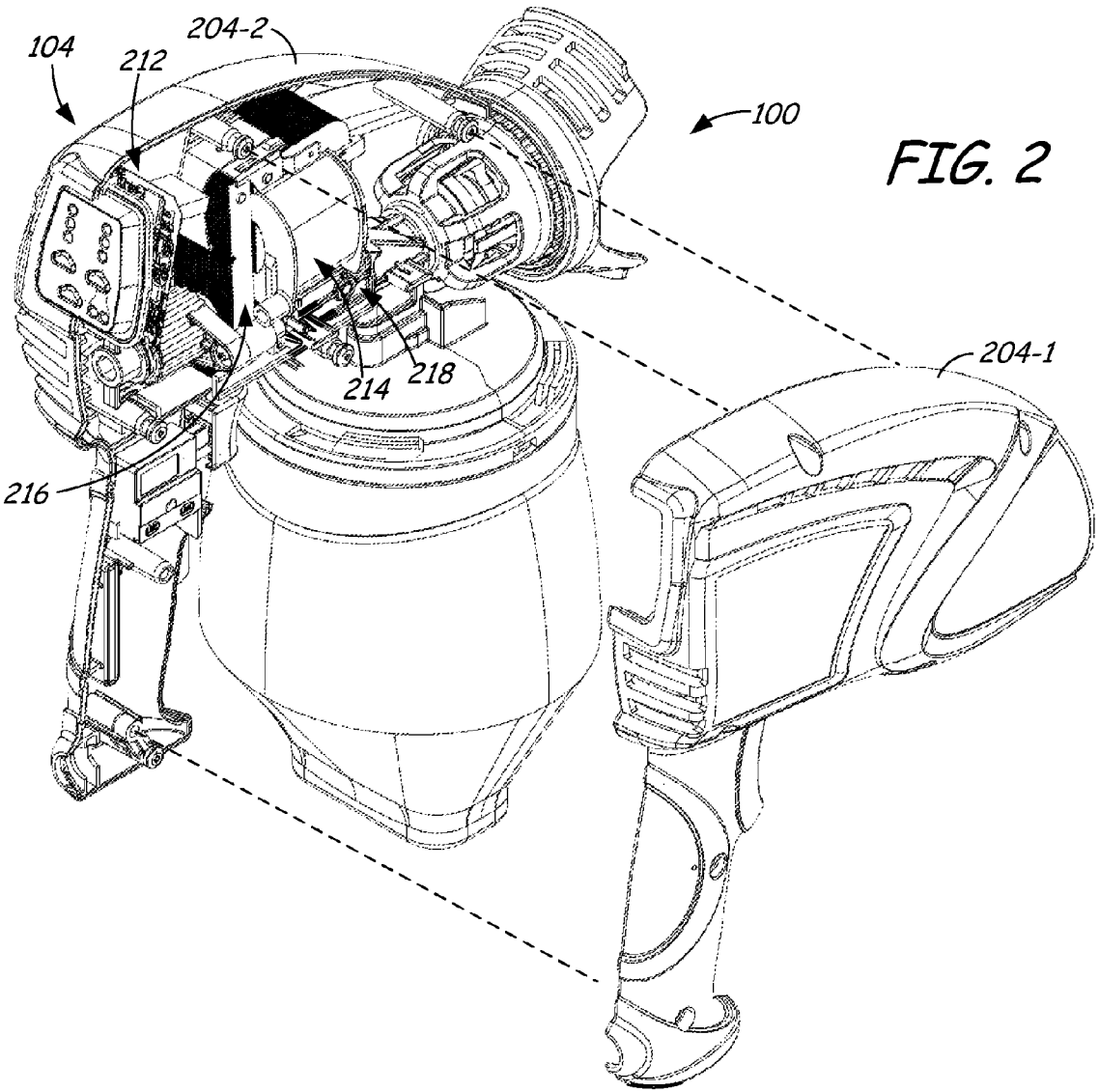
FIG. 2 is a partially exploded perspective view of a handheld fluid sprayer, under one embodiment.

FIG. 2 is a partially exploded perspective view of spray gun 100 illustrating internal components. Housing 104 of spray gun 100 comprises first and second portions 204-1 and 204-2. Together, portions 204-1 and 204-2 house electrical components 212 and an assembly 214 configured to pump paint to the output nozzle (not shown in FIG. 2). In one embodiment, portions 204-1 and 204-2 comprise case halves that are mirror images of one another. In other embodiments, housing portions 204-1 and 204-2 can have different shapes and/or sizes.

In the illustrated embodiment, assembly 214 comprises a motor assembly 216 and a pump assembly 218, and is referred to herein as a "motor/pump assembly". Motor assembly 216 comprises an electric motor or drive operably configured to drive a fluid pump mechanism of pump assembly 218.

Figure 3:
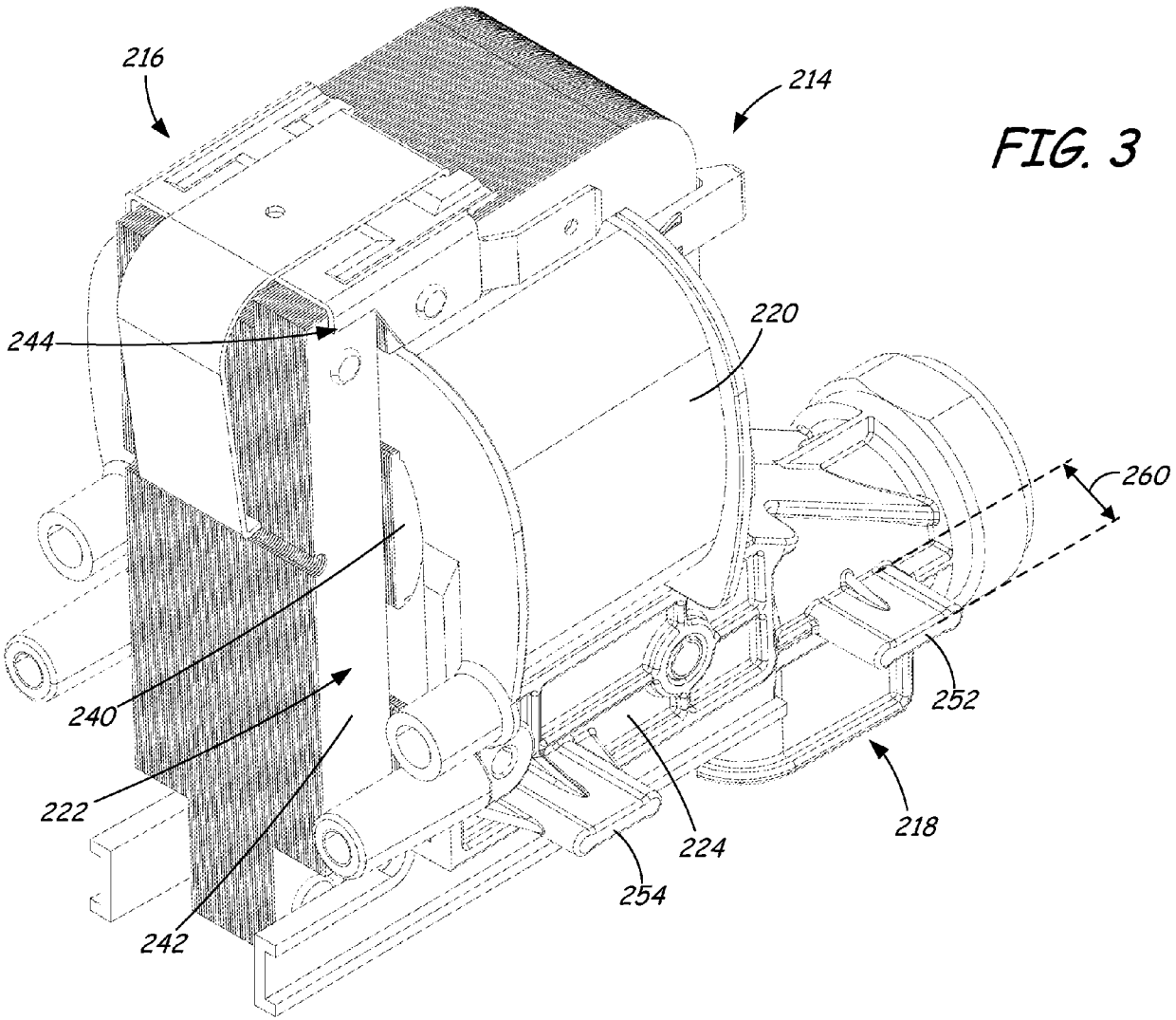
FIG. 3 is a perspective view of a motor/pump assembly of a fluid sprayer, under one embodiment.
Figure 4:
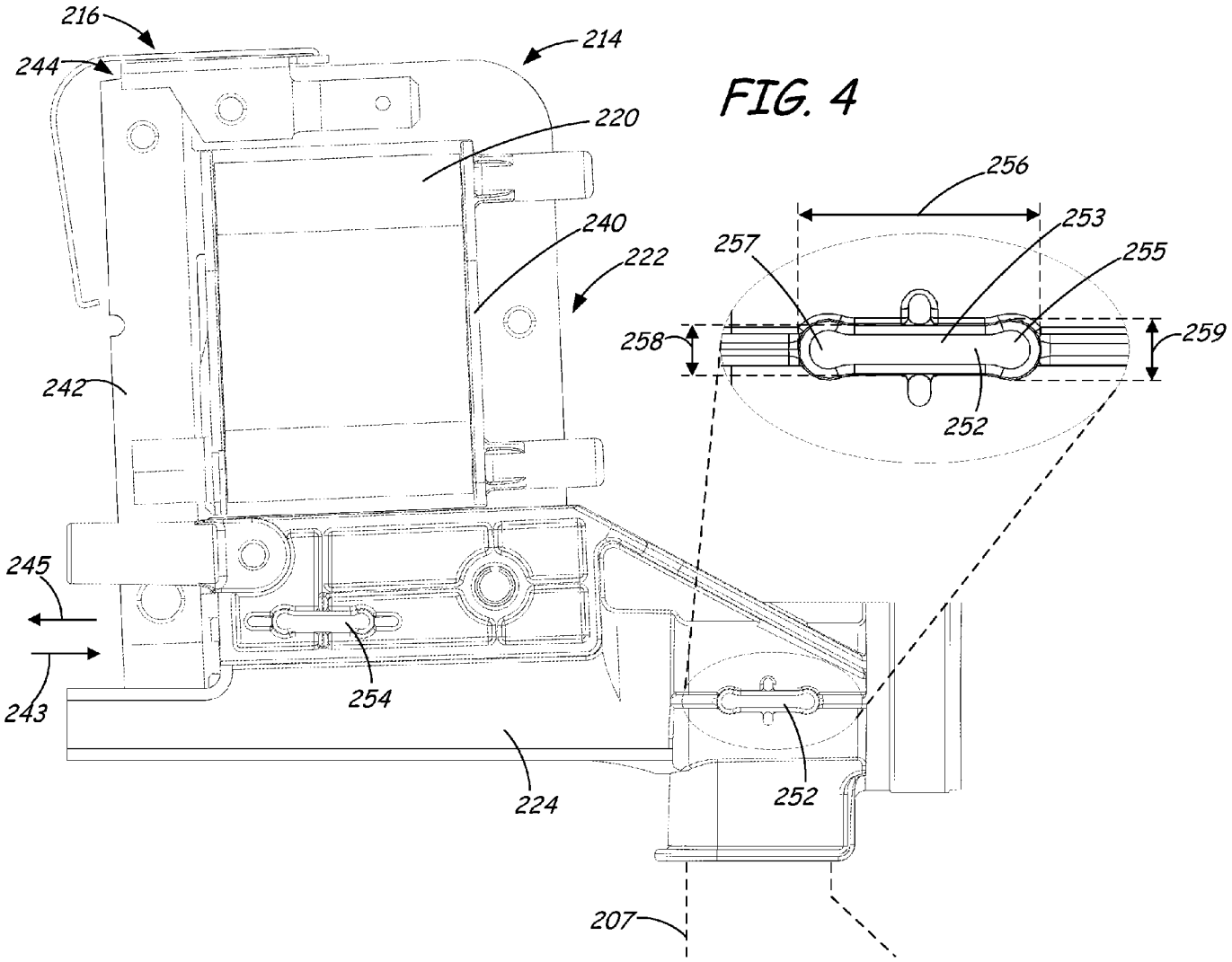
FIG. 4 is a side view of the motor/pump assembly illustrated in FIG. 3.

FIGS. 3 and 4 are perspective and side views, respectively, illustrating one embodiment of motor/pump assembly 214. For illustration purposes, some components of assembly 214 are omitted in FIGS. 3 and 4.

Motor assembly 216 comprises an electric motor or drive that is operable to drive the pump assembly 218. In one embodiment, some or all of the weight of the fluid container (i.e., fluid container 102) is supported by pump assembly 218. For example, portion 107 of spray gun 100 (illustrated in FIG. 1 and generally represented in FIG. 4 by dashed lines 207) extends into housing 104 and is attached or otherwise supported by pump assembly 218.

In the illustrated embodiment, the electric motor or drive comprises a reciprocating electromagnetic actuator 222 that drives a reciprocation member (e.g., oscillating piston, plunger, membrane, etc.) disposed within a housing 224 of pump assembly 218. In one embodiment, actuator 222 operates by applying pulses as a function of an AC power source, for example, to a coil 220 of the actuator 222. In one embodiment, a DC power source is utilized to apply pulses to coil 220.

Reciprocating electromagnetic actuator 222 includes a magnetic armature 242 and coil 220 that is wrapped around at least a portion of a laminated stack (or "core") 240. In the illustrated embodiment, the core/coil assembly is stationary or fixed in assembly 214 while the armature 242 is configured to move or pivot using a pivot assembly 244, for example. Thus, the armature 242 moves in one or more directions with respect to the core/coil assembly based on the current applied to the coil 220. In the illustrated embodiment, when current is applied to the coil 220 the armature 242 is magnetically attracted toward the core 240 (in a direction represented by arrow 243). The force at which the armature 242 is attracted toward the core 240 is proportional to (or otherwise related to) the amount of current applied to the coil 220.

Armature 242 is configured to mechanically contact and drive the pump assembly 218. In one embodiment, movement of armature 242 in direction 243 drives the reciprocation member (illustratively a piston disposed within a cylinder of housing 224) in a first direction along a reciprocation axis, which pumps fluid material through a fluid path toward the output nozzle. A biasing mechanism (for example a spring) provides a biasing force to drive the reciprocation member along the reciprocation axis in a second, opposite direction (i.e., direction 245). In this manner, the reciprocation member is configured to move linearly, or at least substantially linearly, along the reciprocation axis in directions 243 and 245. By way of example, the reciprocation axis bisects the reciprocation member and/or can be aligned with the spray axis of the spray nozzle.

To illustrate, during a first action a current is applied to coil 220 causing the armature 242 to actuate the piston in the first direction along the reciprocation axis and pump paint through the fluid path to the output. During a second action, the current in the coil 220 is removed (or otherwise reduced) causing the spring to actuate the piston in the second direction along the reciprocation axis. This operates to draw additional fluid from the fluid container (i.e., container 102) which is then pumped to the output nozzle during a subsequent action of the pump assembly 218. The current applied to coil 220 is pulsed between high and low values to cause reciprocation of armature 242 and the piston in directions 243 and 245. As such, a significant amount of the vibration generated by assembly 214 is oriented along the reciprocation axis.

To reduce the amount of vibration that is transferred from assembly 214 to housing 104, assembly 214 is supported within housing 104 using a plurality of isolation mounts. The isolation mounts are designed with sufficient strength characteristics to support the weight of and properly align assembly 214 within housing 104 while providing enhanced vibration isolation and/or damping capabilities. In one embodiment, the isolation mounts support a substantial portion (i.e., most or all) of the weight of assembly 214 and include vibration isolation features that are configured to isolate the housing 104 from a significant portion of the vibration generated by assembly 214.

Figure 5:
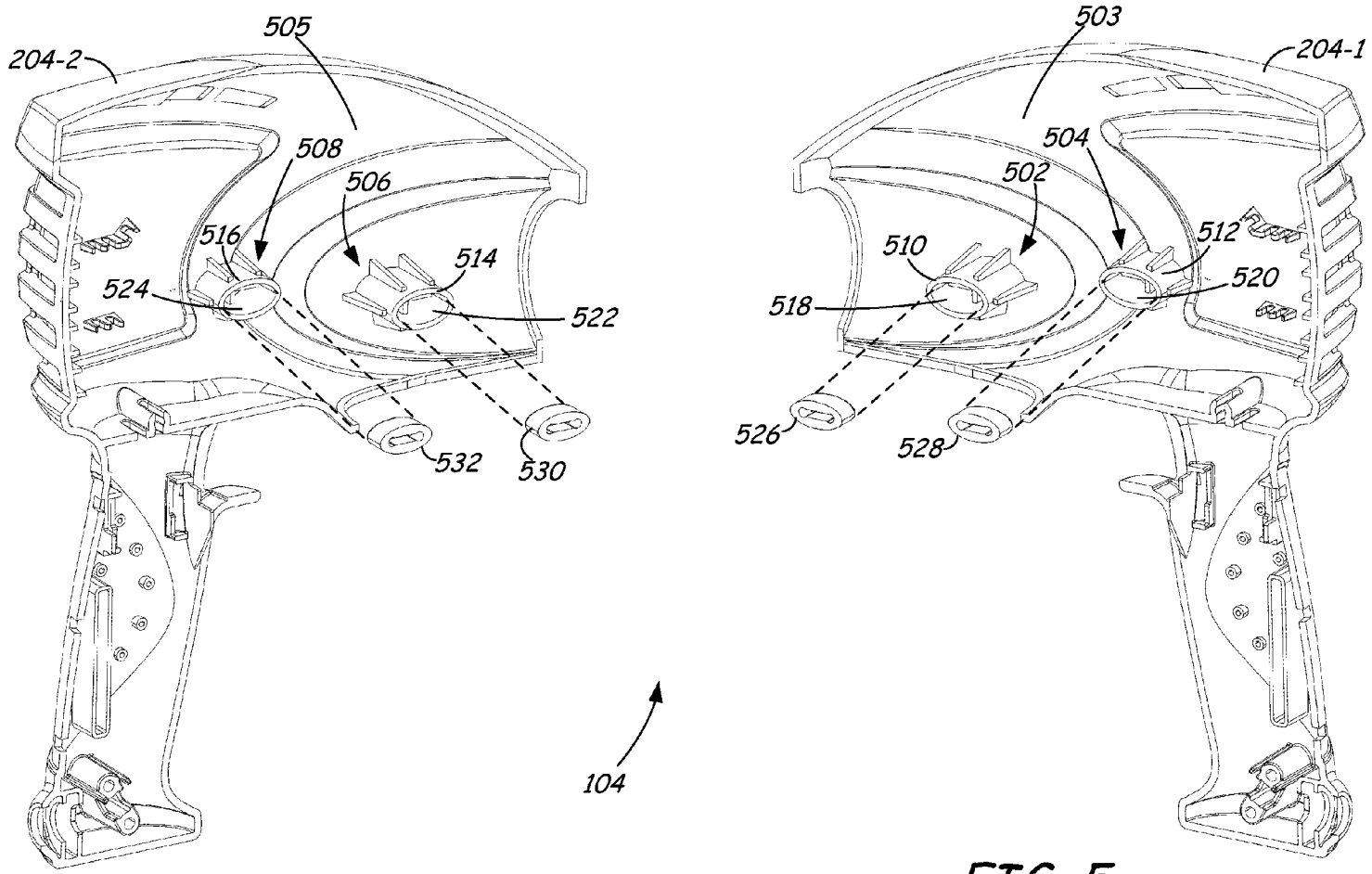
FIG. 5 is a perspective view of a fluid sprayer housing including isolation mounts, under one embodiment.

In the embodiment illustrated in FIG. 5, at least two isolation mounts 502 and 504 are provided on the first portion 204-1 of housing 104 and at least two isolation mounts 506 and 508 are provided on the second portion 204-2 of housing 104. Mounts 502 and 504 are located on and support a first side of assembly 214 and mounts 506 and 508 are located on and support a second, opposite side of assembly 214. Each isolation mount 502, 504, 506, 508 comprises a projection 510, 512, 514, 516 formed on or otherwise rigidly attached to housing 104. Projections 510, 512, 514, 516 extend from interior surfaces 503 and 505 of housing 104 toward assembly 214 and includes openings 518, 520, 522, 524 configured to receive and support a portion of assembly 214 therein. As illustrated, projections 510 and 512 receive and support tabs 252 and 254 (shown in FIGS. 3 and 4), respectively, formed on a first side of assembly 214 and projections 514 and 516 receive and support tabs (not shown in FIGS. 3 and 4) formed on a second, opposite side of assembly 214. In one example, the assembly support tabs formed on the second side of assembly 214 are substantially similar to tabs 252 and 254.

Assembly support tab 252 has an elongated, cross-section having a width 256 (in a direction parallel, or at least substantially parallel, to the reciprocation axis) that is greater than a height 258 (in a direction perpendicular, or at least substantially perpendicular, to the reciprocation axis). In one example, width 256 is approximately 0.5 inches and height 258 is approximately 0.1 inches. In one example, a length 260 of tab 252 is approximately 0.4 inches.

In the illustrated embodiment, support tab 252 has a "dogbone" shape including enlarged portions 255 and 257 formed at ends of a planar portion 253. The height 259 of portions 255 and 257 is greater than height 258 of portion 253. In other embodiments, tab 252 is formed without enlarged portions 255 and 257.

Referring again to FIG. 5, each of isolation mounts 502, 504, 506, 508 comprise a vibration isolation component 526, 528, 530, 532 that is accommodated within openings 518, 520, 522, 524 of projections 510, 512, 514, 516. Vibration isolation components 526, 528, 530, 532 provide interfaces between projections 510, 512, 514, 516 and assembly support tabs (e.g., tabs 252, 254) of assembly 214 supported within projections 510, 512, 514, 516. For example, components 526, 528, 530, 532 are formed of a material suitable to provide isolation of vibration between assembly 214 and housing 104. Components 526, 528, 530, 532 are formed of a flexible, resilient material such as, but not limited to, polymers, elastomers, etc. In one embodiment, components 526, 528, 530, 532 are formed of a material having a hardness less than approximately 50 durometer Shore A. In one particular embodiment, components 526, 528, 530, 532 are formed of plastisol having a hardness of approximately 24 durometer Shore A and thickness of approximately 0.12 inches.

While isolation mounts 502, 504, 506, 508 are illustrated as comprising a projection located on a housing 104 and configured to receive a support tab, it is noted that the features of mounts 502, 504, 506, 508 can be provided on different components. For instance, in one embodiment mounts 502, 504, 506, 508 can comprise projections provided on assembly 214 configured to receive support tabs on housing 104.

Figure 6:
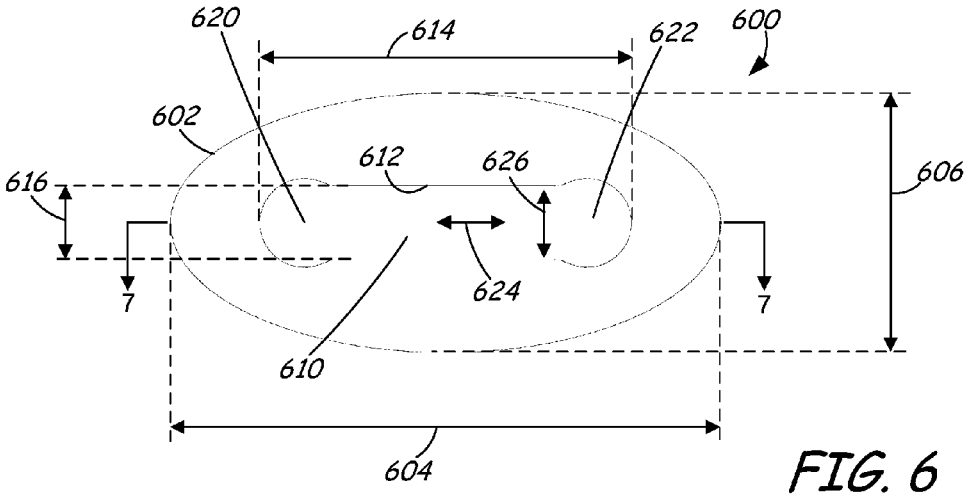
FIGS. 6 and 7 are side and cross-sectional views, respectively, of a vibration isolation component, under one embodiment.
Figure 7:
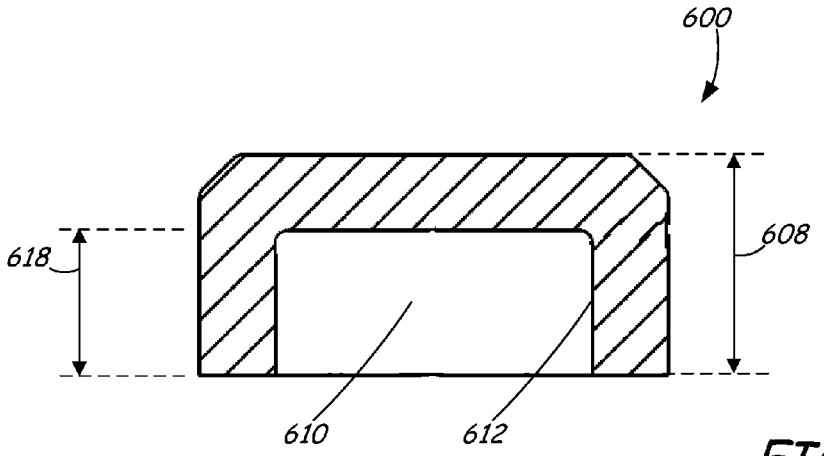

FIGS. 6 and 7 illustrate an exemplary vibration isolation component 600, under one embodiment. FIG. 7 includes a cross-section of component 600 taken at line 7-7 shown in FIG. 6. Component 600 has a generally elliptical outer peripheral surface 602. A length 604 of component 600 is greater than a height 606. In one embodiment, length 604 is approximately 0.74 inches and height 606 is approximately 0.35 inches. A width 608 of component 600 is approximately 0.35 inches, in one embodiment. An opening 610 is formed by an inner surface 612 and is sized to accommodate tab 252 formed on assembly 214. In one embodiment, opening 610 has a size and shape that is substantially similar to tab 252. For instance, opening 610 illustratively includes an elongated cross-section having a length 614 of approximately 0.5 inches and a height 616 of approximately 0.1 inches. The depth 618 of opening 610 is approximately 0.23 inches, in one embodiment. In the illustrated embodiment, opening 610 has a "dogbone" shape similar to tab 252 and includes enlarged portions 620 and 622 sized to accommodate portions 255 and 257 of tab 252.

The configurations of vibration isolation components 526, 528, 530, 532 and assembly support tabs of assembly 214 supported therein allow assembly 214 to move with respect to housing 104 to a greater extent in first (i.e., horizontal) directions (represented by double arrows 624) as compared to second (i.e., vertical) directions (represented by double arrows 626). Directions 622 are parallel, or at least substantially parallel, to the reciprocation axis of assembly 214 while directions 622 are perpendicular, or at least substantially perpendicular, to the reciprocation axis. To illustrate when the assembly support tab 252 moves in first (i.e., horizontal) directions 624 with respect to component 600 (for example, oscillatory movement of assembly 214 caused by reciprocation of components of assemblies 216 and/or 218), the surface area of tab 252 that contact and deform component 600 is smaller than the surface area of tab 252 that contacts and deforms components 600 when assembly 214 moves in other directions (i.e., vertically in directions 626). In this manner, projections 510, 512, 514, 516 and components 526, 528, 530, 532 are configured to more rigidly support and align assembly 214 with respect to housing 104 in vertical directions 626 as compared to horizontal directions 624. Thus, isolation mounts 502, 504, 506, 508 can maintain proper alignment of assembly 214 within housing 104 while enabling enhanced vibration isolation and/or damping characteristics resulting in reduced vibration transferred to housing 104. This reduced vibration can result in significantly lower noise levels emanating from housing 104 during operation.

Figure 8:
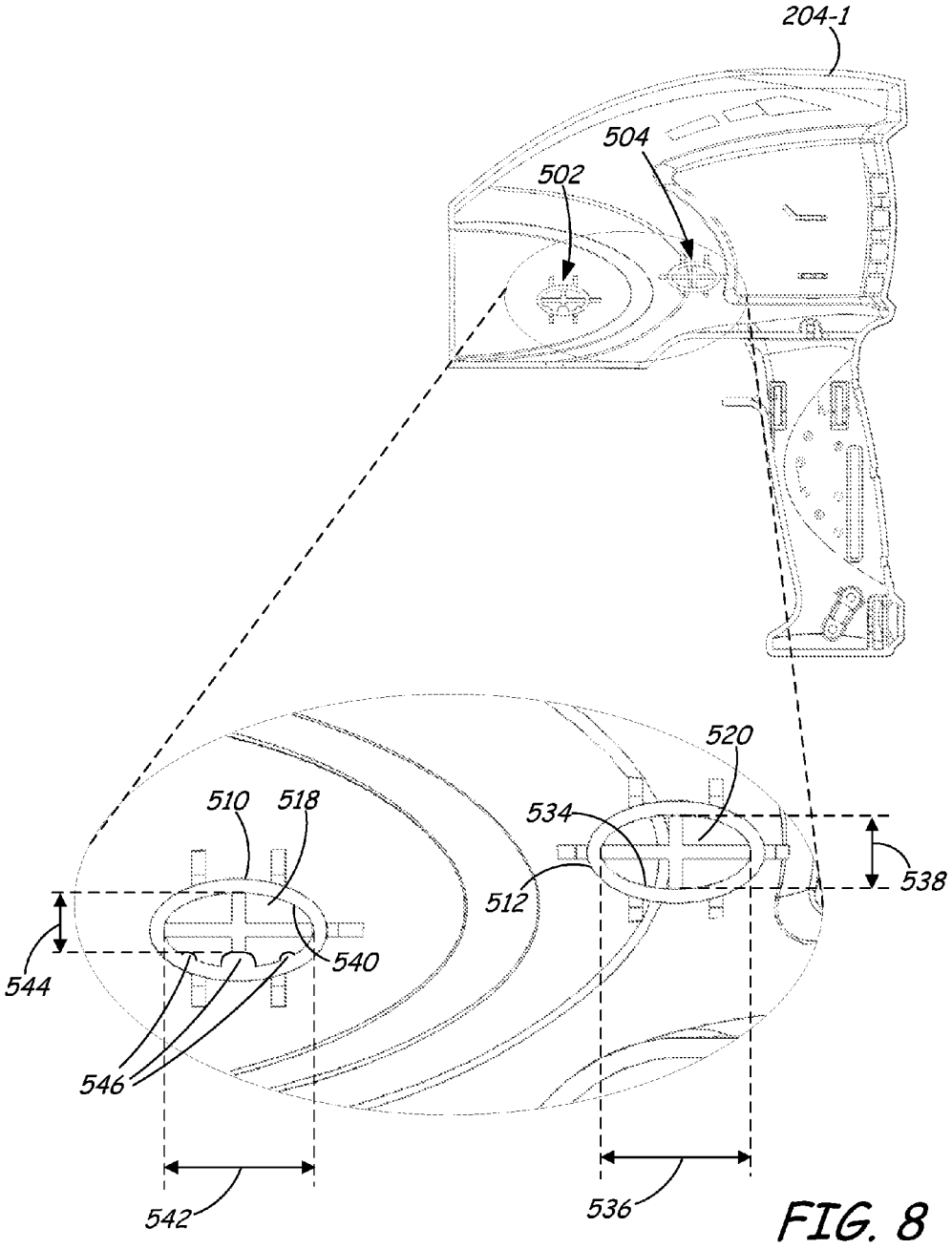
FIG. 8 is a side view of a fluid sprayer housing including isolation mounts, under one embodiment.

FIG. 8 is a side view of housing portion 204-1 illustrating one embodiment of isolation mounts 502 and 504. Projection 512 of mount 504 has an inner surface 534 forming opening 520 sized to receive a vibration isolation component, such as component 600 illustrated in FIG. 6. Opening 520 is generally elliptical and includes, for example, dimensions 536 and 538 that are similar to length 604 and height 606 of component 600, respectively. In one embodiment, dimensions 536 and 538 are the same as length 604 and height 606. In other embodiments, dimensions 536 and 538 can be slightly larger (or smaller) than length 604 and height 606, respectively. In one particular embodiment, dimension 536 is approximately 0.75 inches and dimension 538 is approximately 0.375 inches.

In the embodiment illustrated in FIG. 8, projection 510 of mount 502 has an inner surface 540 forming opening 518 sized to receive a vibration isolation component, such as component 600 illustrated in FIG. 6. Opening 518 of projection 512 has a first dimension 542 that is the same as, or similar to, dimension 536. As mentioned above with respect to FIG. 4, in some embodiments some or all of the weight of a fluid container (i.e., fluid container 102) is supported by pump assembly 218. In some cases (such as a full container) this weight can be significant. To support this weight and maintain proper alignment of assembly 214 within housing 104, a second dimension 544 of projection 510 is reduced by adding one or more ribs 546 along a bottom of opening 518. In this manner, dimension 544 is smaller than dimension 538 of projection 512. It is noted that instead of changing the configuration of projection 510, the vibration isolation component received within projection 510 can be modified (i.e., height 606 can be increased).

Figure 9:
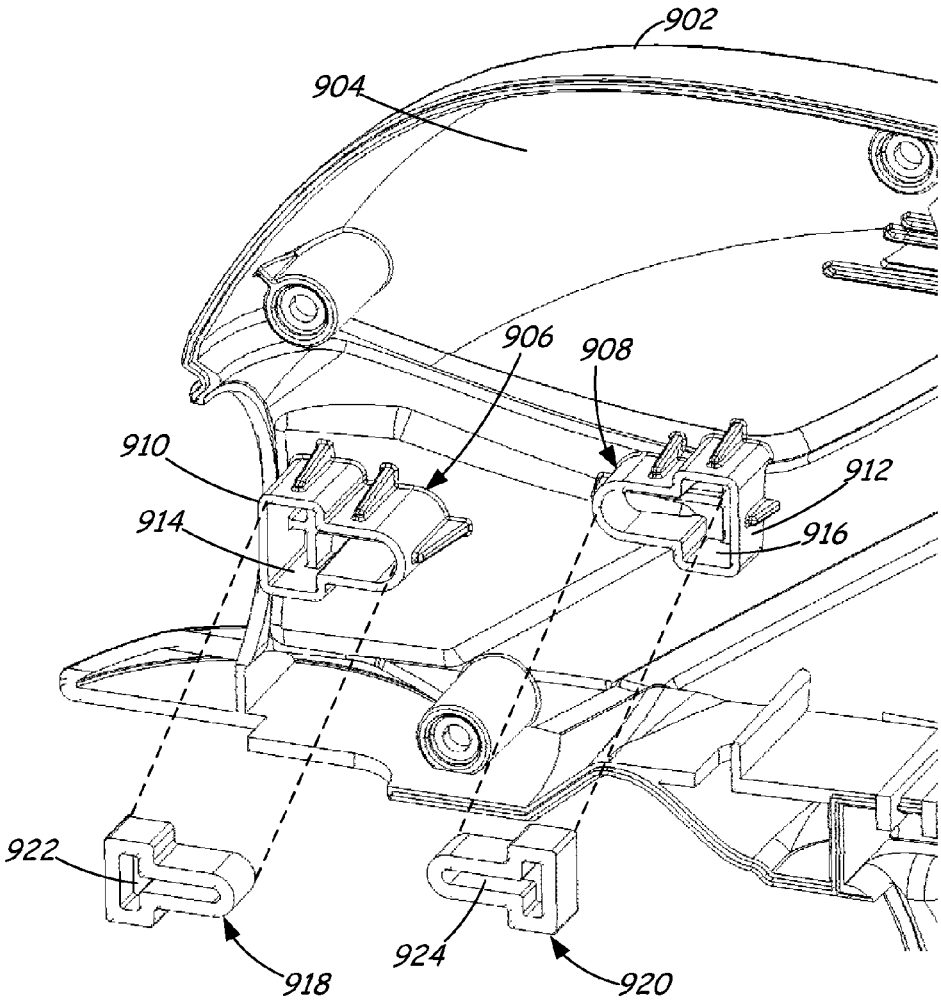
FIG. 9 is a perspective view of a portion of a fluid sprayer housing including isolation mounts, under one embodiment.

FIG. 9 is a perspective view of a portion of a fluid sprayer housing 902 including isolation mounts, under one embodiment. At least two isolation mounts 906 and 908 are provided on an interior surface 904 of housing 902 and are configured to support a motor/pump assembly, such as motor/pump assembly 1102 illustrated in FIG. 11 and described below. Vibration isolation components 918 and 920 are positioned in interface between the motor/pump assembly and the housing 902 and can be formed of any suitable material to isolate and/or dampen vibrations generated by the motor/pump assembly. For example, vibration isolation components 918 and 920 can be formed of a flexible, resilient material such as, but not limited to, plastisol, rubber, or other elastomers. In one example, vibration isolation components 918 and 920 are formed of a material having a hardness of less than 20 durometer Shore A. In one particular embodiment, components 918 and 920 are formed of silicone having a hardness of approximately 10 durometer Shore A. Surfaces of components 918 and 920 can have a uniform thickness and/or varying thickness.

Housing 902 illustratively comprises one portion, or case half, of a fluid sprayer housing and is configured to support a first side of the motor/pump assembly. A second fluid sprayer housing portion (which is substantially a minor image of housing 902 in one embodiment) is provided to support a second side of the motor/pump assembly.

Each isolation mount 906 and 908 comprises a projection 910 and 912 that extends from the interior surface 904 toward the motor/pump assembly and forms an opening 914 and 916 configured to receive a vibration isolation component 918 and 920. Each vibration isolation component 918 and 920 includes an opening 922 and 924 that is configured to receive and support a portion of the motor/pump assembly.

Figure 10:
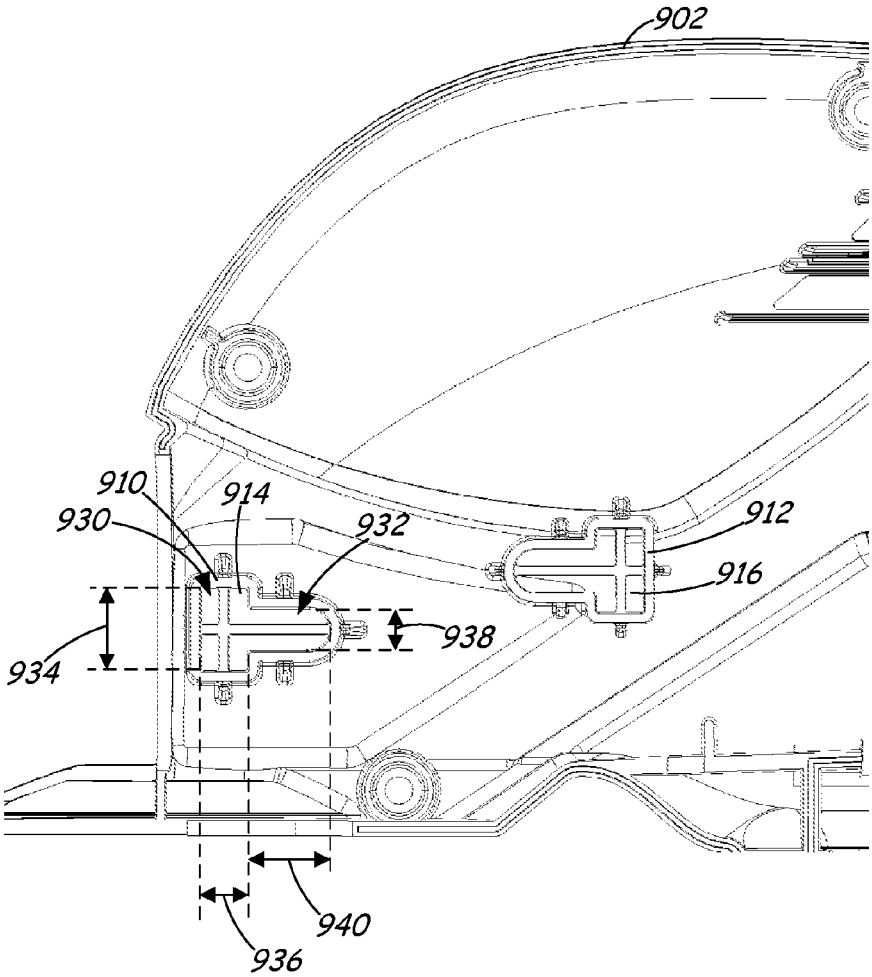
FIG. 10 is a side view of the portion of the fluid sprayer housing illustrated in FIG. 9.

FIG. 10 is a side view of the portion of housing 902 illustrated in FIG. 9. Opening 914 formed by projection 910 comprises a first portion 930 and a second portion 932. The first portion 930 of opening 914 has a height 934 and a width 936. The second portion 932 of opening 914 has a height 938 and a width 940. In the illustrated embodiment, projections 910 and 912 are minor images of one another.

Figure 11:
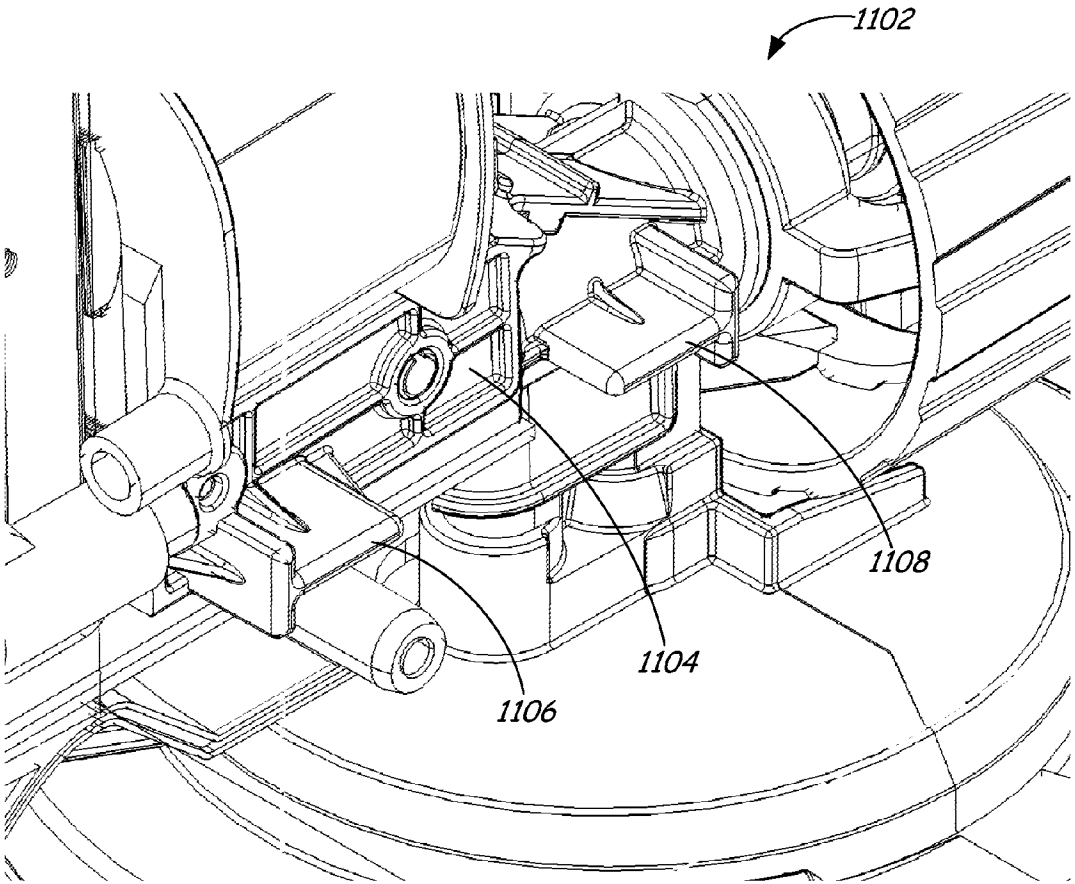
FIG. 11 is a perspective view of a portion of a motor/pump assembly, under one embodiment.

FIG. 11 is a perspective view of a portion of a motor/pump assembly 1102. As illustrated, assembly 1102 includes a plurality of assembly support protrusions or tabs 1106 and 1108 extending from a first side of an assembly body 1104. In the illustrated embodiment, assembly support protrusions 1106 and 1108 are minor images of one another and are configured to be received within and supported by openings 922 and 924 of vibration isolation component 918 and 920. A second side of assembly body 1104 also includes a plurality of assembly support protrusions (not shown in FIG. 11).

Figure 12:
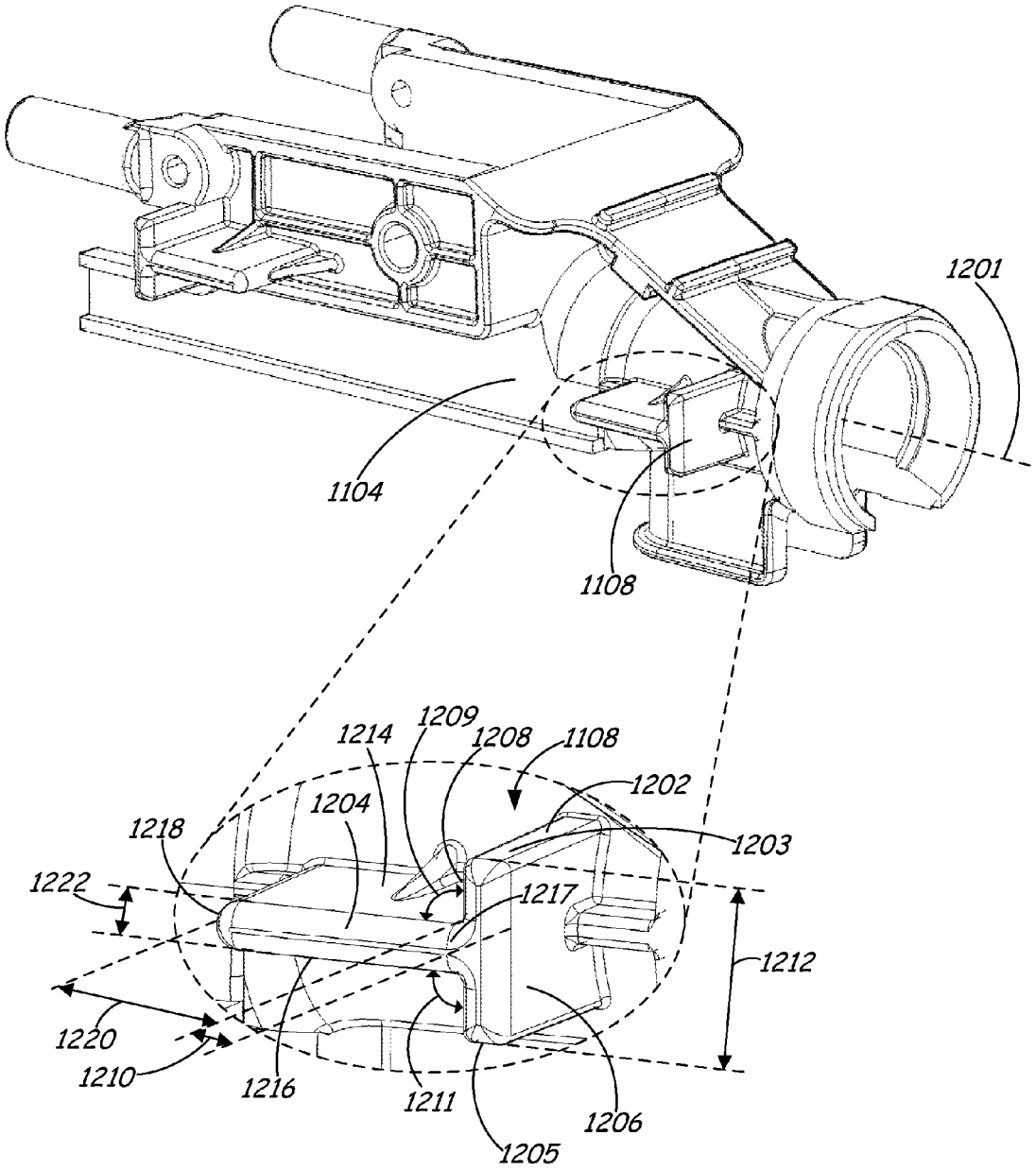
FIG. 12 is a perspective view of a motor/pump assembly body including isolation mounts, under one embodiment.

FIG. 12 is a perspective view of assembly body 1104, and includes an enlarged view of assembly support protrusion 1108, under one embodiment. As illustrated, protrusion 1108 is "T-shaped" and includes a first portion 1202 extending in a generally vertical direction and a second portion 1204 extending in a generally horizontal direction. Portions 1202 and 1204 extend in directions that are generally perpendicular and parallel, respectively, to a reciprocation axis (represented by broken line 1201) of a reciprocating member (i.e., a piston pump) of motor/pump assembly 1102.

Portion 1202 has a first surface 1206 and second, opposed surface 1208. Portion 1204 has a first surface 1214 and a second, opposed surface 1216. Surface 1214 extends away from surface 1208 at an angle 1209. Likewise, surface 1216 extends away from surface 1208 at an angle 1211. In the illustrated embodiment, surface 1214 is at least substantially orthogonal to surface 1208 and surface 1216 is at least substantially orthogonal to surface 1208 (i.e., angles 1209 and 1211 are approximately ninety degrees).

In the illustrated embodiment, surfaces 1206 and 1208 face in opposite directions and are parallel, or at least substantially parallel, to one another. Surfaces 1214 and 1216 face in opposite directions and are parallel, or at least substantially parallel, to one another. In one embodiment, surfaces 1206 and 1208 (and/or surfaces 1214 and 1216) can be oriented at a relatively small angle with respect to each other. Portion 1202 has a top surface 1203, a bottom surface 1205, a height 1212, and a width 1210. Portion 1204 has a height 1222 and a width 1220. Portion 1204 is directly attached to portion 1202 at a first end 1217, and has a second, rounded end 1218. Portions 1204 and 1206 can be integral, formed of a single unitary body, or can be formed of separate bodies coupled by suitable attachment means. In the illustrated embodiment, portion 1204 is vertically centered on surface 1208 of portion 1202. In other words, surface 1214 is positioned a first distance from end 1202 that is substantially the same as a second distance between surface 1216 and end 1205.

Figure 13:
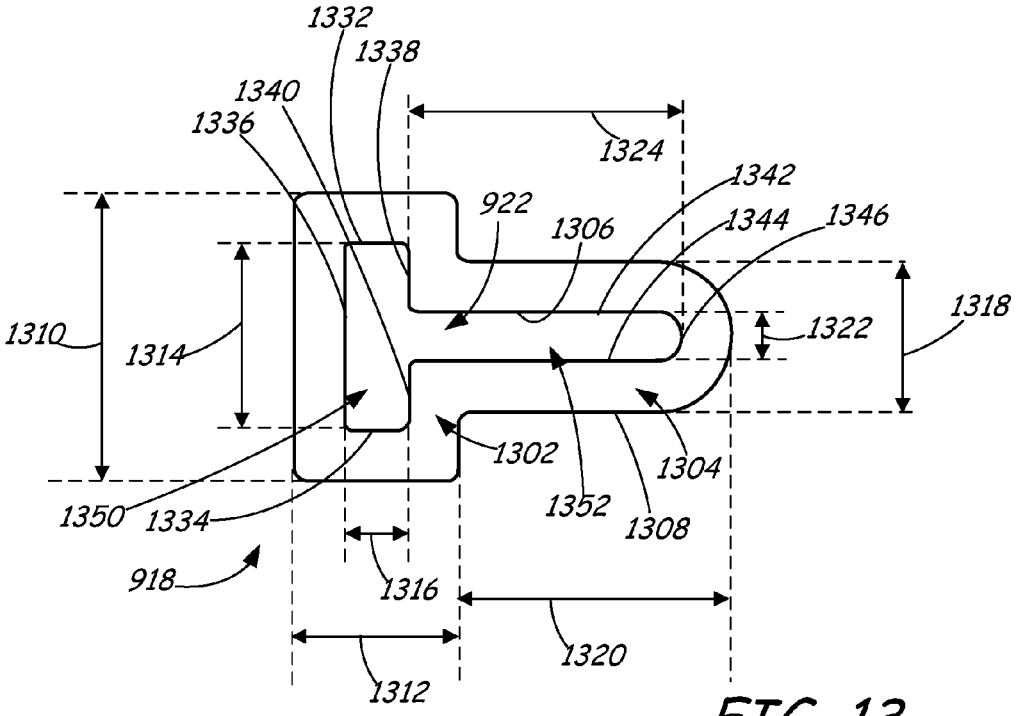
FIG. 13 is a side view of a vibration isolation component, under one embodiment

FIG. 13 is a side view of vibration isolation component 918. Component 918 comprises a first portion 1302 and a second portion 1304 configured to be received within the first and second portions 930 and 932 of opening 914, respectively. Component 918 has an inner surface 1306 defining opening 922 and an outer surface 1308. The first portion 1302 has a height 1310 and a width 1312 sized to be received within the first portion 930 of opening 914. The second portion 1304 has a height 1318 and a width 1320 sized to be received within the second portion 932 of opening 914. In one embodiment, the outer dimensions (i.e., surface 1308) of component 918 are substantially the same as corresponding dimensions of opening 914. In one embodiment, the outer dimensions of component 918 are slightly smaller than or slightly larger than the corresponding dimensions of opening 914. For example, component 918 can be deformed to some extent for insertion into opening 914.

Inner surface 1306 is formed by a plurality of inner surface portions 1332, 1334, 1336, 1338, 1340, 1342, 1344 and 1346. A first portion 1350 of opening 922 has a height 1314 and a width 1316 and a second portion 1352 of opening 922 has a height 1322 and a width 1324. Portions 1350 and 1352 of opening 922 are sized to receive portions 1202 and 1204 of assembly support protrusion 1108, respectively. In one embodiment, the dimensions of assembly support protrusion 1108 are substantially the same as corresponding dimensions of opening 922. In one embodiment, the dimensions of assembly support protrusion 1108 are slightly larger than or slightly smaller than the corresponding dimensions of opening 922. For example, component 918 can be deformed to some extent to insert protrusion 1108 into opening 922.

As the motor/pump assembly 1102 vibrates during operation of the fluid sprayer, vibration isolation component 918 (and other vibration isolation component(s) supporting the motor/pump assembly 1102) operates to isolate the vibrations from the fluid sprayer housing. The material of component 918 deforms, to some extent, as the vibrations move the motor/pump assembly 1102 with respect to the isolation mounts of the sprayer housing, thereby reducing the level of vibration transferred to the sprayer housing. Further, in addition to providing enhanced vibration isolation characteristics, the configuration of isolation mounts 906 and 908 and assembly support protrusions 1106 and 1108 provide enhanced material durability and reduced material wear of the vibration isolation components 918 and 920.

Surfaces 1203 and 1214 engage and deform corresponding surfaces 1332 and 1342 of component 918, to some extent, when motor/pump assembly 1102 moves in a first vertical direction (i.e., perpendicular to the reciprocation axis). Similarly, surfaces 1205 and 1216 engage and deform corresponding surfaces 1334 and 1344 of component 918, to some extent, when motor/pump assembly 1102 moves in a second, opposite vertical direction. Likewise, surface 1206 engages and deforms corresponding surface 1336 of component 918, to some extent, when motor/pump assembly 1102 moves in a first horizontal direction (i.e., parallel to the reciprocation axis). Similarly, surfaces 1208 and 1218 engage and deform corresponding surfaces 1338, 1340, and 1346 of component 918, to some extent, when motor/pump assembly 1102 moves in a second, opposite horizontal direction.

In the illustrated embodiment, the surfaces of the vibration isolation component 918 contacting the support protrusion 1108 and limiting movement of the motor/pump assembly 1102 in each vertical direction collectively have a greater surface area than the surfaces of the vibration isolation component 918 contacting the support protrusion 1108 and limiting movement of the motor/pump assembly 1102 in each horizontal direction. In other words, the length of surface 1336 (and the collective length of surfaces 1338, 1340, and 1346) is less than the collective length of surfaces 1332 and 1342 (and the collective length of surfaces 1334 and 1344). In this manner, the motor/pump assembly 1102 is more rigidly retained with respect to the housing in the vertical direction as opposed to the horizontal direction. The isolation mounts provide enhanced isolation and/or damping of vibrations generated by the motor/pump assembly while retaining the motor/pump assembly in proper alignment within the housing.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A handheld fluid sprayer comprising:

a housing;

an assembly having at least one of a motor and a fluid pump; and at least one assembly support feature, the assembly being mounted to the housing with the at least one assembly support feature, wherein the at least one assembly support feature comprises:

a first portion having first and second opposed surfaces;

a protrusion configured to receive the tab, wherein one of the tab and the projection extend from a side of the assembly toward the housing; and a T-shaped vibration isolation component disposed about the tab between the protrusion and the tab.

2. The handheld fluid sprayer of claim 1 and further comprising a second portion having first and second opposed surfaces, wherein the second portion extends from the first portion such that at least one of the first and second surfaces of the second portion is at least substantially orthogonal to the second surface of the first portion.

3. The handheld fluid sprayer of claim 1, wherein the vibration isolation component comprises an elastomeric material.

4. The handheld fluid sprayer of claim 2, wherein the assembly comprises a reciprocating member configured to reciprocate along a reciprocation axis, and wherein at least one of the first and second surfaces of the first portion is at least substantially perpendicular to the reciprocation axis and at least one of the first and second surfaces of the second portion is at least substantially parallel to the reciprocation axis.

5. The handheld fluid sprayer of claim 4, wherein both the first and second surfaces of the second portion are at least substantially parallel to the reciprocation axis.

6. The handheld fluid sprayer of claim 4, wherein both the first and second surfaces of the first portion are at least substantially perpendicular to the reciprocation axis.

7. The handheld fluid sprayer of claim 2, wherein both the first and second surfaces of the second portion are at least substantially orthogonal to the second surface of the first portion.

8. The handheld fluid sprayer of claim 7, wherein the first surface of the first portion is at least substantially parallel to the second surface of the first portion.

9. The handheld fluid sprayer of claim 2, wherein the first portion has a first end and a second end, the first and second opposed surfaces of the first portion extending at least partially between the first and second ends, and wherein the first surface of the second portion is positioned a first distance from the first end and the second surface of the second portion is positioned a second distance from the second end.

10. The handheld fluid sprayer of claim 9, wherein the first and second distances are substantially the same distance.

11. The handheld fluid sprayer of claim 2, wherein the second portion has a first end and a second end directly attached to the first portion, wherein the first and second surfaces of the second portion extend between the first end and the second end.

12. A motor/pump assembly for a handheld fluid sprayer, the assembly comprising:

an assembly body housing a reciprocating member configured to reciprocate along a reciprocation axis; and at least one assembly support feature extending from the assembly body and configured to support the assembly body within a fluid sprayer housing, wherein the at least one assembly support feature comprises:

a first portion having first and second surfaces, wherein at least one of the first and second surfaces of the first portion defines a plane that is at least substantially perpendicular to the reciprocation axis;

a second portion having first and second surfaces, wherein at least one of the first and second surfaces of the second portion defines a plane that is at least substantially parallel to the reciprocation axis;

a protrusion configured to receive the first and second portions; and a dog-bone shaped vibration isolation component disposed about the first and second portions between the protrusion and the first and second portions.

13. The motor/pump assembly of claim 12, wherein the reciprocation member comprises a piston pump.

14. The motor/pump assembly of claim 12, wherein the vibration isolation component comprises an elastomeric material.

15. A vibration isolation mount for mounting a motor/pump assembly in a handheld fluid sprayer housing, the vibration isolation mount comprising:

a first component extending from one of a body of the motor/pump assembly and an interior surface of the fluid sprayer housing, the first component comprising a first portion having first and second opposed surfaces, and a second portion extending from the second surface of the first portion and having first and second opposed surfaces;

a second component comprising a projection extending from the other one of the body of the motor/pump assembly and the interior surface of the fluid sprayer housing, the projection having an opening formed therein; and a T-shaped vibration isolation component configured to be received within the opening of the projection and disposed between the first component and the second component, wherein the vibration isolation component also includes an opening formed therein for accommodating the first component such that the first component is inserted within the vibration isolation component which is inserted within the second component.

16. The vibration isolation mount of claim 15, wherein the vibration isolation component is formed of a resilient material.

17. The vibration isolation mount of claim 15, wherein the vibration isolation component comprises an elastomeric material.

* * * * *